United States Patent [19]

Sherman, Jr.

[11] Patent Number: 4,551,111

[45] Date of Patent: Nov. 5, 1985

[54] BALL-LIKE CONSTRUCTION FOR A TOY OR THE LIKE

[76] Inventor: Benjamin F. Sherman, Jr., 6329 Mori St., McLean, Va. 22101

[21] Appl. No.: 526,282

[22] Filed: Aug. 25, 1983

[51] Int. Cl.[4] ..... A63H 33/06

[52] U.S. Cl. ..... 446/120; 434/211; 446/122

[58] Field of Search ..... 46/26, 29, 31, 23, 24, 46/25, 16; 434/211, 213, 96; 273/160, 156, 157 R; 446/85, 124, 125, 113, 116, 120, 112, 114, 122

[56] References Cited

U.S. PATENT DOCUMENTS

| | | | |
|---|---|---|---|
| 597,519 | 1/1898 | De Souchet | 46/26 |
| 2,633,662 | 4/1953 | Nelson | 46/25 |
| 3,698,123 | 10/1972 | Heldt | 46/29 |

FOREIGN PATENT DOCUMENTS

| | | | |
|---|---|---|---|
| 2376677 | 9/1978 | France | 46/31 |
| 145722 | 5/1931 | Switzerland | 434/211 |
| 286891 | 3/1953 | Switzerland | 273/157 R |

*Primary Examiner*—Mickey Yu

*Attorney, Agent, or Firm*—Anthony A. O'Brien

[57] ABSTRACT

A hollow ball-like construction is disclosed as including a plurality of hollow wedges having a variety of different shapes and angles, which wedges are mounted on a central disc to form a unitary assembly. Cylindrical and spherical wedges of different configurations are utilized to complete the constructions into a plurality of outlines, such as a trapezoid, a rhombus, a square, a triangle, a pentagon, a hexagon and other irregular outlines.

25 Claims, 27 Drawing Figures

BALL-LIKE CONSTRUCTION FOR A TOY OR THE LIKE

BACKGROUND OF THE INVENTION

1. Field of the Invention

The present invention is directed to a ball-like construction for a toy or the like and, more particularly, to such a construction which may be assembled and disassembled from a variety of shapes.

2. Description of the Prior Art

The prior art is exemplified by U.S. Pat. Nos. 2,783,046, 3,081,089, 3,564,735 and 4,050,184. Such prior art devices disclose various types of toy balls adapted to be assembled and disassembled but all of these balls are directed to spherical constructions and not to constructions that are oddly shaped.

SUMMARY OF THE INVENTION

The present invention is summarized in a ball-like construction for a toy or the like including a plurality of hollow wedge elements, an interior wall in each wedge element integral therewith to strengthen the same, a disc member centrally located within said plurality of hollow wedge elements, and interconnecting means between said disc member and the interior wall of each wedge element adapted to retain said plurality of hollow wedge elements together on said disc member as a unit.

OBJECTS OF THE INVENTION

An object of the present invention is to form a hollow ball-like construction from a plurality of wedge elements.

Another object of this invention is to construct a plurality of different types of wedge elements so that they are interchangeable to form a variety of ball-like shapes.

The present invention has another object in that a plurality of cylindrical wedges and/or partial spherical wedges are formed with the same radius of curvature to make an odd-shaped ball-like construction.

It is a further object of this invention to retain a plurality of hollow wedge elements in a ball-like construction by means of a centrally disposed disc member.

Other objects and advantages of the present invention will become apparent from the following description taken in conjunction with the accompanying drawings.

DESCRIPTION OF THE PREFERRED EMBODIMENT

Figure 1:
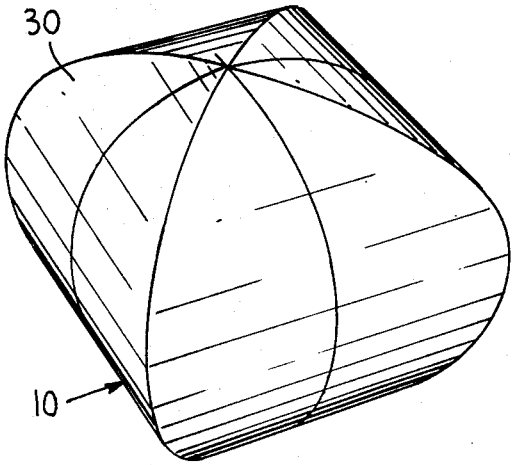
FIG. 1 is a perspective view of a ball-like toy embodying the present invention.
Figure 2:
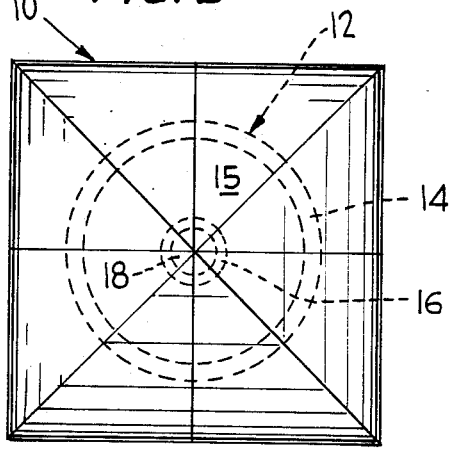
FIG. 2 is a top plan view of FIG. 1 and having a generally square outline.
Figure 3:
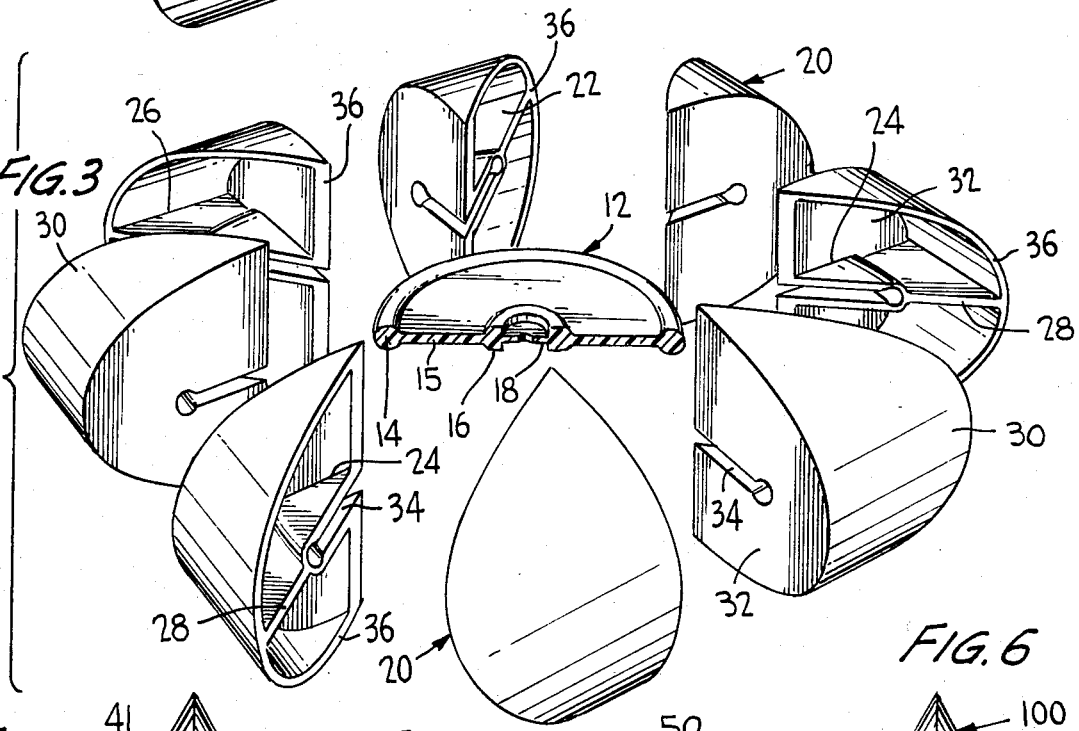
FIG. 3 is an exploded perspective view of the toy of FIGS. 1 and 2.

As is illustrated in FIGS. 1–3, the present invention is embodied in a ball-like toy, indicated generally at 10, which includes central disc 12 having an annular configuration. The disc is formed with an outer circular ring 14 and an inner circular ring 16 separated by an annular wall portion 15; inside the inner ring is a thin circular wall 18 having a central aperture therethrough. The rings 14 and 16 have a thickness slightly larger than the thickness of the annular wall portion (see FIG. 3).

Figure 10:
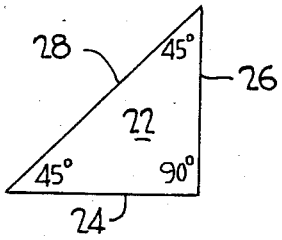
FIG. 10 is a diagram of another reinforcing rib showing the angular relationship of another wedge element utilized in the toy shown in FIGS. 1, 2, 3, 12, 13, 19, 22, 24, 25 and 26.

As is shown in FIG. 3, the toy 10 utilizes eight identical hollow ungulas or wedges 20, so only one wedge will be described in detail for the sake of brevity. Each wedge 20 has an interior reinforcing rib in the shape of a triangular wall 22 defined by its base side 24, its height side 26 and its hypotenuse side 28 as illustrated in the diagram of FIG. 10. The height side 26 of the wall 22 is integral with the midline of the solid arcuate wall 30 which has a base edge integral with the edge of a semi-circular end wall 32; the base side 24 of wall 22 is integral with the midline of the semi-circular end wall 32. Extending between its base side 24 and its hypotenuse side 28, the interior wall 22 is formed with a generally U-shaped slot 34, the inner part of which is enlarged to receive the disc ring 14. The opening of the slot 34, at the point between the two sides 24 and 28, engages the disc ring 16. As is apparent from FIG. 3, the open edge of the wedge 20 is defined by a semi-elliptical outline 36.

To assemble the ball-like construction 10 from the components of FIG. 3, the eight wedges 20 are disposed on the disc 12 by placing each U-shaped slot 34 on the disc 12. The assembly is made by alternating the facing surfaces for the wedges 20; thus, the first, third, fifth and seventh wedges have their surfaces reversed with regard to the respective surfaces of the second, fourth, sixth and eighth wedges. With such an arrangement, one wedge has its semi-circular end wall 32 shutting the semi-circular end wall 32 of one adjacent wedge while the semi-elliptical edge 36 abuts the semi-elliptical edge 36 of another adjacent wedge. During assembly, each wedge 20 is mated to the disc 12 and not to other wedges 20, so there is no problem in inserting the final eighth wedge; the rings 14 and 16 on the disc 12 separately interconnect each wedge to the disc 12.

Upon assembly, the ball-like construction 10 has the general outline of a square when observed in a plan view (see FIG. 2). The result is an odd shaped ball 10 that will roll only about two transverse axes, i.e., the north-south axis and east-west axis of FIG. 2. Rolling of the odd shaped ball 10 is easily accomplished since it has its center of gravity located at the exact center of symmetry which coincides with the center of curvature of each wedge of the construction so no kinetic energy is consumed in raising the center of gravity and because the construction is made from light weight plastic as by injection molding. To further enhance its aesthetic appeal, the wedges 20 have different colors so they may be assembled with a variety of designs.

It is also possible to assemble the eight wedges 20 into shapes other than that shown in FIG. 1. For example, FIGS. 25 and 26 utilize the same components of FIG. 3 in forming a windmill 230; the eight wedges 20 are mounted on the disc 12 in the same manner with the surface 32 of one wedge abutting the semi-elliptical edge 36 of the adjacent wedge. The central aperture in the central wall 18 of disc 12 permits a string to be inserted through the entire assembly to make a pinwheel 230 that will spin in the wind. Of course, the eight wedges 20 may be arranged in various combinations as by varying the abutting surfaces 32 and 36 in different sequences.

Figure 4:
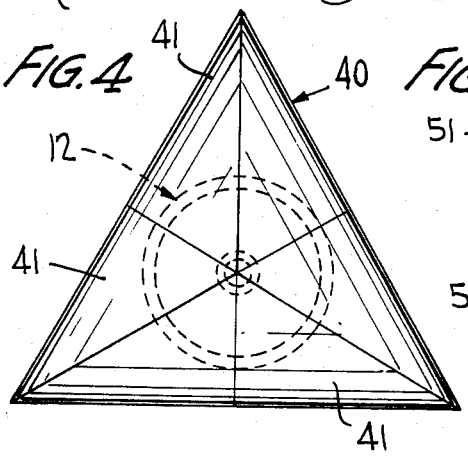
FIG. 4 is a top plan view of a modification of the present invention having a generally triangular outline.
Figure 9:
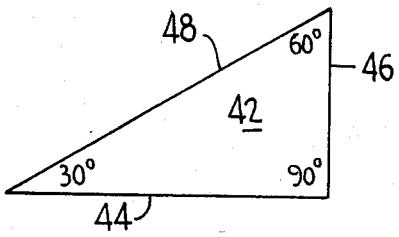
FIG. 9 is a diagram of a reinforcing rib showing the angular relationship of a wedge element utilized in the toy shown in FIGS. 4, 6, 14, 16, 22 and 23.

All of the shapes to be described below utilize the same structure of the disc member 12, so that the following descriptions will be directed to that structure which differs from FIGS. 1–3. Thus, FIG. 4 shows a plan view of a generally triangular ball-like construction 40 made of six wedges 41, each with a 60° central angle, and an interior wall or reinforcing rib 42 (see FIG. 9) having the same structure as rib 22 in FIG. 10 but having different angles therefrom. The interior rib 42 has sides 44, 46 and 48 attached to the interior of the walls of wedge 40 in the same manner as the sides 24, 26 and 28 of the rib 22 in FIG. 3.

Figure 5:
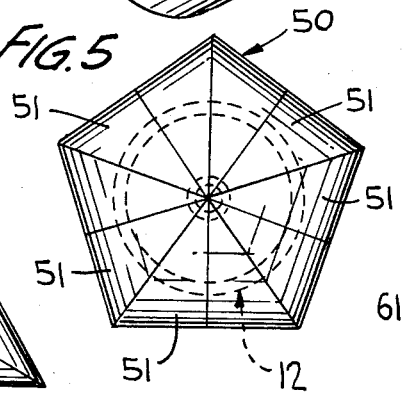
FIG. 5 is a top plan view of another modification of the present invention having a generally pentagonal outline.
Figure 17:
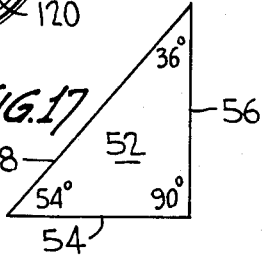
FIG. 17 is a diagram of another reinforcing rib showing the angular relationship of another wedge element utilized in the toy shown in FIG. 5.

FIG. 5 shows a plan view of a generally pentagonal ball-like construction 50 made of ten wedges 51, each with a central angle of 36° and an interior wall or reinforcing rib 52 (see FIG. 17) having the same structure as rib 22 in Fig. 10 but different angles therefrom. The interior rib 52 has sides 54, 56 and 58 attached to the interior of the walls of the wedge 51 in the same manner as the sides 24, 26 and 28 of the rib 22 in FIG. 3. The wedges 51 are mated in pairs along their adjacent end walls (such as 32 in FIG. 3) and adjacent pairs are then mated along their adjacent hypotenuse sides 58.

Figure 6:
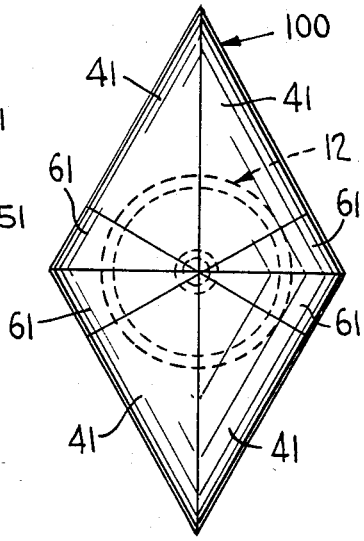
FIG. 6 is a top plan view of another modification of the present invention having a generally rhombic outline.

It is now apparent that the cylindrical wedges forming the ball-like construction need not be identical but only that the mating surfaces between adjacent wedges be the same. Thus in FIG. 6 there is shown a rhombic ball-like construction 100 made of four wedges 41 and four wedges 61, each having a rib 42 as are described above; each wedge 61 has an interior wall or reinforcing rib 62 (see FIG. 11) having the same structure as rib 22 in FIG. 10 but different angles therefrom. The interior rib 62 has sides 64, 66 and 68 attached to the interior of the walls of the wedge 61 in the same manner as the sides 24, 26 and 26 of the rib 22 in FIG. 3. As is shown in FIG. 6, the wedges 41 are each mated in pairs along adjacent their hypotenuse sides 48; the wedges 61 are each mated in pairs along their adjacent hypotenuse sides 68. The four pairs of wedges are then alternately mated along their adjacent end walls such as wall 32 in FIG. 3.

Figure 7:
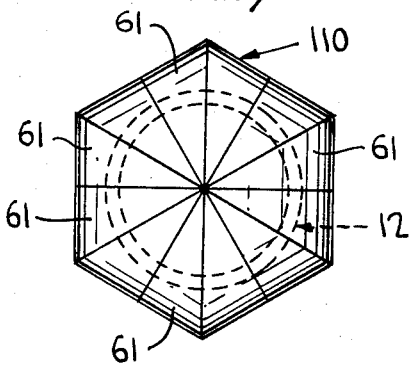
FIG. 7 is a top plan view of another modification of the present invention having a generally hexagonal outline.
Figure 11:
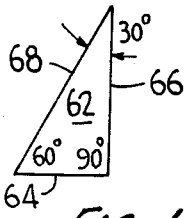
FIG. 11 is a diagram of another reinforcing rib showing the angular relationship of another wedge element utilized in the toy shown in FIGS. 6, 7, 8, 12, 15, 16, 22, 23 and 24.

FIG. 7 shows a plan view of a generally hexagonal ball-like construction 110 made of twelve wedges 61 having a central angle of 30° as seen in FIG. 11 and as described above. The wedges 61 are mated in pairs along their adjacent end walls (such as end wall 32 in FIG. 3) and each pair are then mated along their adjacent hypotenuse sides 68.

Figure 8:
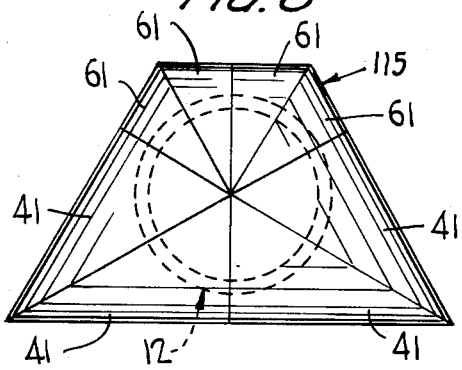
FIG. 8 is a top plan view of another modification of the present invention having a generally trapezoidal outline.

FIG. 8 shows a plan view of a generally trapezoidal ball-like construction 115 made of four wedges 61 and four wedges 41. The wedges 41 are mated in pairs along their hypotenuse sides 48 and the pairs are then mated along adjacent end walls (such as end wall 32 in FIG. 3); the wedges 61 are mated in pairs along their hypotenuse sides 68 and the pairs are then mated along adjacent end walls (such as end wall 32 in FIG. 3). Then the two end walls of the pairs of wedges 41 are mated to the adjacent end walls of the pairs of wedges 61 to complete the trapezoidal configuration.

Figure 12:
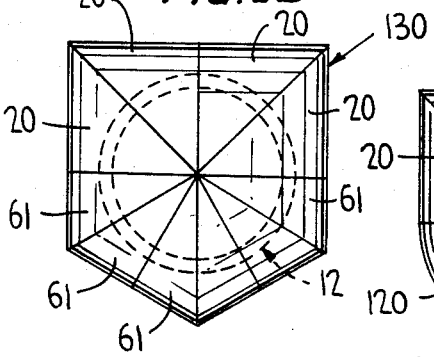
FIG. 12 is a top plan view of another modification of the present invention having a generally irregular outline formed by a rectangular portion joined by a half of a hexagonal portion.

FIG. 12 shows a plan view of a ball-like construction 130 having an irregular outline formed by a upper half portion of rectangular configuration and a lower half portion of a half of a hexagon. The upper half portion is made of four wedges 20, each having a central angle of 45° as shown in FIG. 10 and as described above. The lower half portion is made of six wedges 61, each having a central angle of 30° as shown in FIG. 12 and as described above. The four wedges 20 are mated in pairs along their hypotenuse sides 48 and the pairs are then mated along adjacent end walls 32 as shown in FIG. 3. Four of the six wedges 61 are mated into pairs along their end walls (such as end walls 32 in FIG. 3) and the remaining two wedges 61 are mated, one on each hypotenuse side 68. The two remaining end walls of the wedges 61 are then mated with the two remaining end walls 32 of the wedges 20 to complete the irregular outline.

Figure 13:
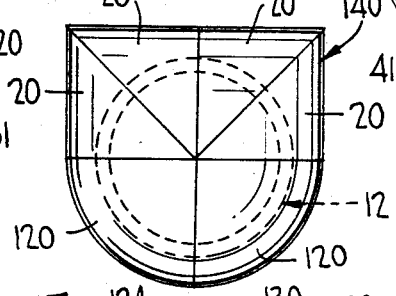
FIG. 13 is a top plan view of another modification of the present invention having a generally irregular outline formed by a rectangular portion joined to a semicircular portion.
Figure 13A:
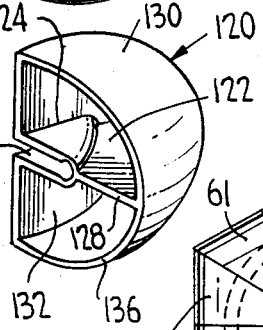
FIG. 13A is a perspective view of a partial spherical hollow wedge utilized in the toy shown in FIGS. 13, 15 and 16.

FIG. 13 shows a plan view of a ball-like construction 140 having an irregular outline formed by an upper half portion of rectangular configuration identical to the upper portion of FIG. 12 so that it is not being described again. The lower half portion includes two partial spherical hollow wedges 120, each having a central angle of 90°. Each wedge 120 (see FIG. 13A) has an interior reinforcing rib or wall 122 having two sides 124 and 128 at right angles to each other and an arcuate side (not shown) integrally joined to the mid-line of a solid arcuate wall 130 similar to the rib joined to the arcuate wall 30 in FIG. 3. The arcuate wall 130 has a base edge integral with the edge of a semi-circular end wall 132. Extending from its side 124 to its other side 128, the interior wall 122 is formed with a generally U-shaped slot 134. While the components of wedge 120 are similar to those of wedge 20, the angles are all at 90° so that while the side 128 is not a hypotenuse it may be considered a hypotenuse side to compare with 28 in FIG. 3; the open edge of the wedge 120 is defined by a semi-circular outline.

The wedges 120 are mated to each other along their adjacent sides 136 and then each end wall 132 is mated to adjacent end walls 30 of the upper rectangular portion to complete the irregular outline.

Figure 14:
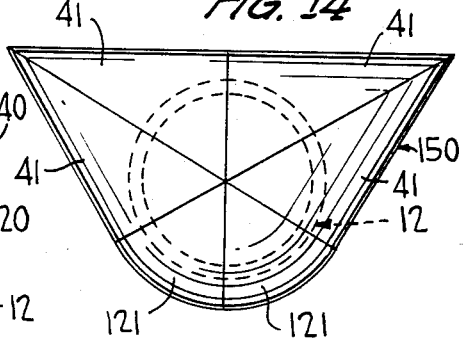
FIG. 14 is a top plan view of another modification of the present invention having a generally irregular outline formed by a partial triangular portion joined to a partial circular portion.

FIG. 14 shows a plan view of a ball-like construction 150 having an irregular outline formed by an upper portion of a partial triangle and a lower portion of two partial spherical wedges 121. The upper portion includes four wedges 41 mated in pairs along their hypotenuse sides 48 and then mated along adjacent base sides 46. The lower portion includes the two wedges 121 which are similar to the spherical wedges 120 but differs therefrom in that each wedge 121 has a central angle of 60° while the wedge 120 has a central angle of 90°. The two end walls (similar to 132 in FIG. 13A) are mated to the adjacent base sides 46 of the upper portion to complete the irregular outline.

Figure 15:
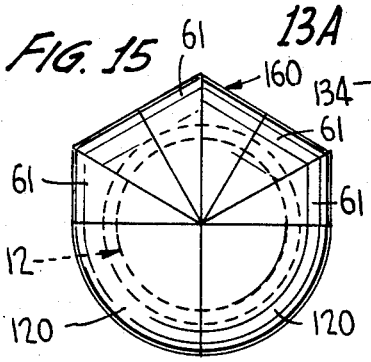
FIG. 15 is a top plan view of another modification of the present invention having a generally irregular outline formed by a half of a hexagonal portion joined to a semicircular portion.

FIG. 15 shows a plan view of a ball-like construction 160 having an irregular outline formed by an upper portion which is half of a hexagon identical to the lower portion of FIG. 12. The lower portion of FIG. 15 has a hemispherical outline and is identical to the lower portion of FIG. 13 so it will not be described further. The irregular outline is completed by mating the exposed end walls of the wedges 61 to the adjacent end walls 132 of the wedges 120.

Figure 16:
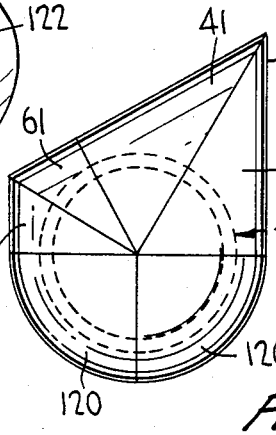
FIG. 16 is a top plan view of another modification of the present invention having a generally irregular outline formed by a trapezoidal portion joined to a semicircular portion.

FIG. 16 shows a plan view of a ball-like construction 170 having an irregular outline formed by an upper portion of trapezoidal configuration and a lower portion of hemispherical outline identical to the lower portion of FIG. 13 which will not be described further. The upper portion includes two wedges 41 mated along their hypotenuse sides 48 and two wedges 61 mated along their hypotenuse sides 68; the adjacent end walls of the mated wedges are then mated to each other to form the trapezoidal outline. The two end walls 132 of wedges 120 are then mated to the remaining two end walls of the trapezoidal outline to complete the irregular outline.

Figure 18:
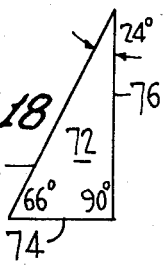
FIG. 18 is a diagram of another reinforcing rib showing the angular relationship of another wedge element utilized in a toy similar to the one shown in FIG. 19.

The triangular reinforcing rib 72 in FIG. 18 includes a base side 74, a height side 76 and a hypotenuse side 78, which sides enclose a central angle of 24° and a base angle of 66°. Wedges formed according to FIG. 18 may be combined to form an irregular hexagonal outline similar to that shown in FIG. 19. Such an irregular hexagonal outline would include six wedges from FIG. 18 using their central angle of 24° and six wedges 51 shown in FIGS. 5 and 17 using their central angle of 36°, alternately arranged in pairs similar to the arrangement shown in FIG. 19.

Figure 19:
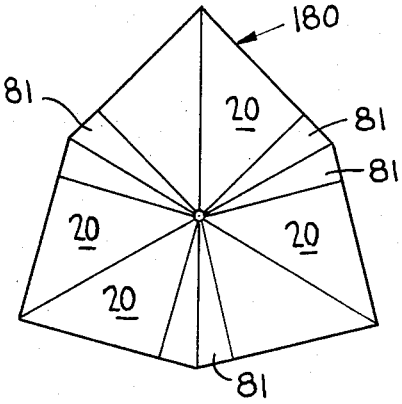
FIG. 19 is a top plan view of another modification of the present invention having a generally hexagonal outline.
Figure 21:
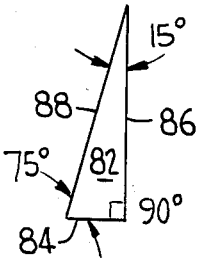
FIG. 21 is a diagram of another reinforcing rib showing the angular relationship of another wedge element utilized in the toy shown in FIGS. 19 and 20.

FIG. 19 shows a plan view of a ball-like construction 180 having an irregular hexagonal outline formed from six wedges 20 mated in pairs along their hypotenuse sides 28 and six wedges 81 mated in pairs along their hypotenuse sides 88. As is shown in FIG. 21, the interior rib 82 for the wedges 81 includes a base side 84, a height side 86 and a hypotenuse side 88, which sides enclose a central angle of 15° and a base angle of 75°. The mated pairs of wedges 20 and 81 are alternately arranged with their adjacent end walls (such as 32 in FIG. 3) mated together to complete the irregular hexagonal outline.

Figure 20:
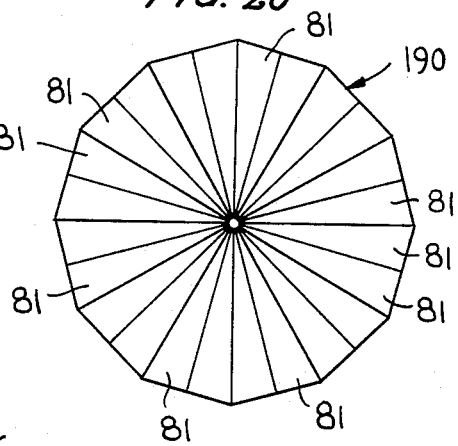
FIG. 20 is a top plan view of another modification of the present invention having a generally polygonal outline formed with twelve equal sides.

FIG. 20 shows a plan view of a ball-like construction 190 having a regular polygonal outline with twelve sides formed from twenty-four wedges 81 mated in pairs along their hypotenuse sides 88 and then mated along their adjacent end walls (such as 32 in FIG. 3) to complete the regular twelve-sided polygonal outline.

Figure 22:
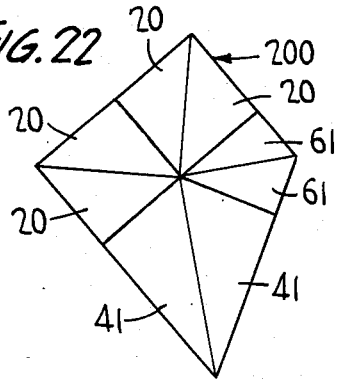
FIG. 22 is a top plan view of another modification of the present invention having a generally irregular outline formed with four unequal sides.

FIG. 22 shows a plan view of a ball-like construction 200 having an irregular polygonal outline formed from eight wedges including four wedges 20, two wedges 41 and two wedges 61. The upper portion of the outline includes the four wedges 20 arranged in a rectangular configuration identical to the upper portion of FIG. 12 so that it is not being described further. The lower portion includes the two wedges 41 and the two wedges 61 arranged in a trapezoidal configuration identical to the upper portion of FIG. 16 so that it is not being described further. The above wedges are mated in pairs along their hypotenuse sides and the upper and lower portions are mated along the exposed end walls of adjacent wedges to complete the irregular polygonal outline.

Figure 23:
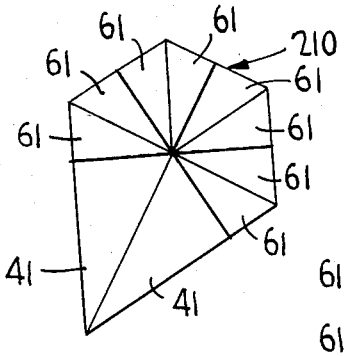
FIG. 23 is a top plan view of another modification of the present invention having a generally irregular outline with five sides, two of which are equal but are unequal with regard to three other equal sides.

FIG. 23 shows a plan view of a ball-like construction 210 having an irregular polygonal outline formed from ten wedges including two wedges 41 and eight wedges 61. The wedges 41 are arranged in a pair by being mated along their hypotenuse sides 48 and the wedges 61 are arranged in pairs by being mated along their hypotenuse sides 68. The end walls (such as 32 in FIG. 3) of the pairs of wedges 61 are mated together leaving two end walls exposed, which are then mated to the adjacent end walls of the two wedges 41 to complete the irregular polygonal outline.

Figure 24:
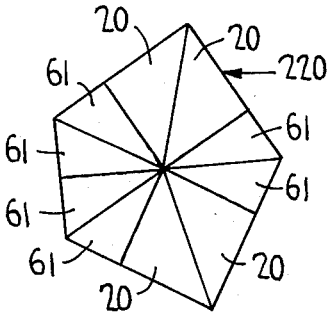
FIG. 24 is a top plan view of another modification of the present invention having a generally irregular outline with five sides, four of which are equal.

FIG. 24 shows a plan view of a ball-like construction 220 having an irregular polygonal outline formed from ten wedges including four wedges 20 and six wedges 61. The wedges 20 are mated into two pairs along their hypotenuse sides 28. The wedges 61 are mated into three pairs along their hypotenuse sides 68; two pairs of wedges 61 are mated together along their adjacent end walls (such as 32 in FIG. 3) leaving a first pair of exposed end walls spaced from each other and a second pair of exposed end walls spaced from each other. A first pair of wedges 20 have their exposed end walls 32 mated to the first pair of exposed end walls of wedges 61. A second pair of wedges 20 have their exposed end walls 32 mated to the second pair of exposed end walls of wedges 61, thus completing the irregular polygonal outline.

Figure 25:
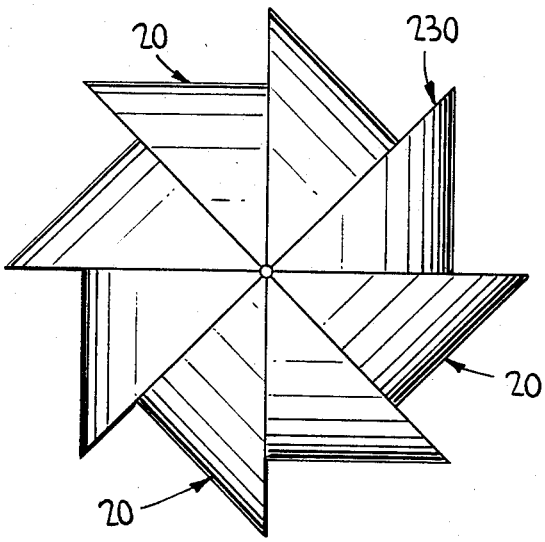
FIG. 25 is a top plan view of a windmill embodying of the present invention and made from the wedge elements shown in FIGS. 1–3.
Figure 26:
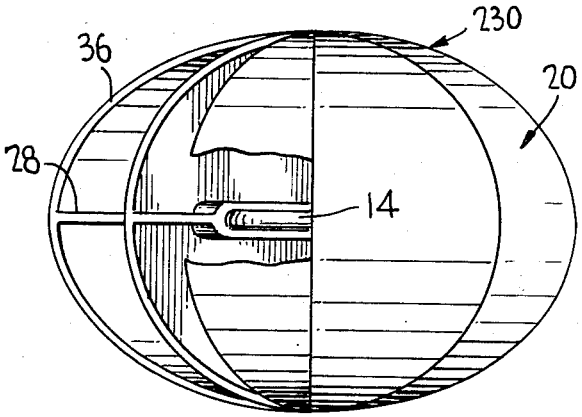
FIG. 26 is a side elevational view of FIG. 25 with a part broken away.

In the above described outlines, it should be noted that except for the windmill 230 in FIGS. 25 and 26, the assemblies are made by mating a hypotenuse side (i.e. the opened side) only with another hypotenuse side and by mating an end wall with another end wall. The solid arcuate wall (such as 30 in FIG. 3) is obviously not mated with any other wall. This mating arrangement is possible because the radius of curvature (such as 32 in FIG. 3 and as 132 in FIG. 13A) is the same on all the disclosed cylindrical wedges and spherical wedges. The ball-like constructions are not limited to those described above because the various types of disclosed wedges may be utilized to construct other types of shapes. For example, all of the wedges shown in FIGS. 3, 4 and 7 have been combined into ten different constructions.

The above ball-like constructions have the unusual result of being able to roll, rock and waddle, which make them attractive to children as well as adults. They are easy to assemble and to take any one apart, which may be accomplished by squeezing gently the two half portions in both hands while prying the thumbs apart outwardly.

While the wedges may be assembled on the disc in the ways described above, it is also possible that assembly may be made in a variety of the ways, such as mating some end walls with some hypotenuse sides. The resulting outline would satisfy the curiosity and imagination of a child in constructing an odd shaped outline.

Inasmuch as the present invention is subject to many modifications, various and changes in detail, it is intended that all matter contained in the foregoing description or shown in the accompanying drawings, shall be interpreted as illustrative and not in a limiting sense.

What is claimed is:

1. A ball-like construction for a toy or the like comprising a plurality of hollow wedge elements, each wedge element having an arcuate wall and an end wall, an interior wall in each wedge element integral with said arcuate wall and said end wall and extending therebetween to strengthen each wedge element, a disc member centrally located within said plurality of hollow wedge elements, and interconnecting means between said disc member and the interior wall of each wedge element to retain said plurality of hollow wedge elements on said disc member as a unit.

2. A ball-like construction for a toy or the like as claimed in claim 1 wherein said plurality of wedge elements are identically shaped.

3. A ball-like construction for a toy or the like as claimed in claim 1 wherein each of said wedge elements are formed as a cylindrical wedge.

4. A ball-like construction for toy or the like as claimed in claim 1 wherein some of said plurality of wedge elements are each shaped as a partial spherical wedge and the remainder of said plurality of wedge elements are each shaped as a cylindrical wedge.

5. A ball-like construction for a toy or the like as claimed in claim 4 wherein said plurality of wedge elements each have the same radius of curvature.

6. A ball-like construction for a toy or the like as claimed in claim 1 wherein said interconnecting means comprises an outer peripheral ring on said disc member and a slot in each interior wall receiving a part of each outer ring.

7. A ball-like construction for a toy or the like as claimed in claim 6 wherein said interconnecting means further includes an inner ring on said disc member, said slot in each interior wall receiving a part of each inner ring.

8. A ball-like construction for a toy or the like as claimed in claim 7 wherein said inner and outer rings are separated by an annular wall portion having a thickness less than the thickness of each said inner and outer rings.

9. A ball-like construction for a toy or the like as claimed in claim 1 wherein said interior wall has the shape of a right triangle including a 15° angle and a 75° angle.

10. A ball-like construction for a toy or the like as claimed in claim 1 wherein said interior wall has the shape of a right triangle including a 24° angle and a 66° angle.

11. A ball-like construction for a toy or the like as claimed in claim 1 wherein said interior wall has the shape of a right triangle including a 30° angle and a 60° angle.

12. A ball-like construction for a toy or the like as claimed in claim 1 wherein said interior wall has the shape of a right triangle including a 36° angle and a 54° angle.

13. A ball-like construction for a toy or the like as claimed in claim 1 wherein said interior wall has the shape of a right triangle including a pair of 45° angles.

14. A ball-like construction for a toy or the like comprising a plurality of hollow wedge elements, an interior wall in each wedge element integral therewith to strengthen the same, a disc member centrally located within said plurality of hollow wedge elements, interconnecting means between said disc member and the interior wall of each wedge element adapted to retain said plurality of hollow wedge elements together on said disc member as a unit, wherein each wedge element has a solid arcuate wall and an end wall, and wherein said interior wall has the shape of a right triangle defined by a height side integral with said arcuate wall and a base side integral with said end wall.

15. A ball-like construction for a toy or the like as claimed in claim 14 wherein said plurality of hollow wedge elements includes a set of identical wedges formed into a generally regular outline.

16. A ball-like construction for a toy or the like as claimed in claim 15 wherein said regular outline is generally square.

17. A ball-like construction for a toy or the like as claimed in claim 15 wherein said regular outline is generally triangular.

18. A ball-like construction for a toy or the like as claimed in claim 15 wherein said regular outline is generally rhombic.

19. A ball-like construction for a toy or the like as claimed in claim 15 wherein said regular outline is generally pentagonal.

20. A ball-like construction for a toy or the like as claimed in claim 15 wherein said regular outline is generally hexagonal.

21. A ball-like construction for a toy or the like as claimed in claim 15 wherein said regular outline is generally trapezoidal.

22. A ball-like construction for a toy or the like as claimed in claim 15 wherein said regular outline is generally a windmill outline.

23. A ball-like construction for a toy or the like as claimed in claim 1 wherein a set of non-identical wedges is formed into a generally irregular outline.

24. A ball-like construction for a toy or the like as claimed in claim 23 wherein said irregular outline includes first and second portions of different configurations.

25. A ball-like construction for a toy or the like as claimed in claim 24 wherein said second portion comprises a plurality of partial spherical wedges.

* * * * *